United States Patent [19]

Ahrens et al.

[11] 4,364,665

[45] Dec. 21, 1982

[54] STORAGE AND MIXING SILO FOR BULK MATERIAL

[75] Inventors: Norbert Ahrens, Oelde; Heinrich Klockenbusch, Ahlen, both of Fed. Rep. of Germany

[73] Assignee: Krupp Polysius AG, Beckum, Fed. Rep. of Germany

[21] Appl. No.: 213,811

[22] Filed: Dec. 8, 1980

[30] Foreign Application Priority Data

Dec. 11, 1979 [DE] Fed. Rep. of Germany ..... 2949791

[51] Int. Cl.[3] ..... B01F 13/02

[52] U.S. Cl. ..... 366/106; 366/107; 366/184; 406/90; 222/195

[58] Field of Search ..... 366/101, 106, 107, 184, 366/341; 99/646 S; 406/90, 138; 222/459, 547, 569, 630, 195; 52/192, 195

[56] References Cited

U.S. PATENT DOCUMENTS 4,184,774 1/1980 Krauss ..... 366/107
4,239,421 12/1980 Krauss ..... 366/106 X

FOREIGN PATENT DOCUMENTS 2336984 2/1975 Fed. Rep. of Germany .
2724928 12/1978 Fed. Rep. of Germany ..... 366/341

*Primary Examiner*—Philip R. Coe
*Assistant Examiner*—Joseph M. Pitko
*Attorney, Agent, or Firm*—Learman & McCulloch

[57] ABSTRACT

The invention relates to a storage and mixing silo for bulk material comprising a mixing compartment in the form of an annular chamber. The radial width and the height of the chamber are proportioned to the diameter of the silo, the chamber has a material inlet opening and a material outlet opening circumferentially spaced from one another, and the chamber has a plurality of independently aeratable zones.

22 Claims, 4 Drawing Figures

STORAGE AND MIXING SILO FOR BULK MATERIAL

BACKGROUND OF THE INVENTION

This invention relates to a storage and mixing silo for bulk material wherein a common silo body has a storage compartment and, in the lower part of the silo body, a mixing compartment in the form of an annular chamber which is smaller than the storage compartment. The mixing compartment communicates with the storage compartment through a material inlet opening provided in the inner boundary wall of the annular chamber and has at least one material outlet opening. The silo body includes means for the pneumatic aeration, particularly of the base, of the storage and mixing compartments.

In one known storage and mixing silo for bulk material (DE-OS No. 27 27 499), there is a central mixing compartment which, in its peripheral wall, has a number of material inlet openings through which it communicates with the surrounding base of the storage compartment. In addition, an annular inspection passage is arranged both around the peripheral wall of the mixing compartment and within the body of the silo to enable the various parts of the silo to be monitored and operated. The arrangement of the annular passage around the mixing compartment involves undesirable capital outlay without any possibility of the mixing effect being influenced by the provision of this annular passage alone.

In another known embodiment (DE-OS No. 23 36 984), the base region of the storage compartment is surrounded by an outer annular passage of which the inner boundary wall forms the lower storage ramp of the storage compartment. This annular passage communicates peripherally with the storage compartment through several material inlet openings. As is evident in particular from the measures taken here to transfer the material from the storage compartment to the annular passage, the sole object of this known arrangement is to obtain particularly favourable emptying of the storage compartment. If it is desired to obtain a particular mixing or homogenising effect during the emptying of the storage compartment through the annular passage, a separate mixing chamber has to be fitted which of course involves increased capital outlay.

In a mixing silo known from DE-AS No. 24 17 468, the mixing chamber is formed by a type of annular chamber which is essentially an axial lower extension of the storage compartment from which it is separated solely by a flat, funnel-like base. In the center of this annular chamber, there is a vertical hollow column which, at one end, supports the center of the base of the storage compartment and, at its other end, comprises a central material inlet opening connecting the storage compartment to the annular mixing compartment. In addition, a transverse partition is arranged inside this hollow column, so that the material outlet which is also centrally arranged at the lower end of this hollow column is covered overhead.

SUMMARY OF THE INVENTION

The object of the present invention is to provide a storage and mixing silo of the type mentioned which, despite having structurally favorable dimensions, makes possible the obtaining of a further improved mixing and homogenising effect in relation to the known embodiments mentioned above.

According to the invention, this object is achieved by combination of the following features:

(a) the radial width of the annular chamber is between 0.25 and 0.37 times the diameter of the silo;

(b) the annular chamber has a height which is between 0.7 times and 1.4 times the radial width of the annular chamber;

(c) the material inlet opening and the material outlet opening provided in the outer boundary wall of the annular chamber are staggered in relation to one another in the peripheral direction of the annular chamber and, preferably, are arranged substantially diametrically in relation to one another; and (d) the zones of the annular chamber situated between the material inlet opening and the material outlet opening are capable of being aerated independently of one another.

Since, in the silo construction according to the invention, the material inlet opening and the material outlet opening to the annular chamber mixing compartment are offset relative to one another and, in particular, are arranged substantially diametrically opposite one another, the bulk material situated in the mixing compartment, i.e., all the particles of bulk material, has to traverse an equally long mixing zone in which the bulk material to be mixed has to pass through the various base aeration zones designed to be aerated independently of one another. In this way, the intensity of mixing in the individual base aeration zones may be influenced with advantage by virtue of the fact that they can be aerated independently of one another. By virtue of the relative arrangement of the material inlet opening and the material outlet opening, it is possible to obtain an intense mixing effect because part of the bulk material introduced into the mixing compartment is mixingly delivered in one peripheral direction whilst the rest is mixingly delivered in the other peripheral direction to the material outlet opening. The above-mentioned values in regard to the radial width and lower vertical height of the annular chamber have proved to be particularly favorable so far as this good mixing effect is concerned.

In cases where, in a storage and mixing silo of the type in question, the silo storage compartment has a downwardly inclined, funnel-like base, it is of particular advantage for the lower edge of the funnel-like base of the storage compartment to be adjoined by a cylindrical wall section which forms the inner vertical boundary wall of the annular chamber and which extends to the central aeratable base section of the storage compartment. This structural arrangement provides for the creation at the lower end of the storage compartment of a central, deep settling zone which is favorable especially in terms of a high throughput from the storage compartment to the mixing compartment, the material inlet opening connecting the storage compartment to the mixing compartment being arranged in the inner boundary wall of the annular chamber. This arrangement affords another structural advantage insomuch as that part of the silo body which is situated below the preferably steeply sloping funnel-like base of the storage compartment may be simultaneously used as an annular chamber mixing compartment.

In order effectively to mix and homogenise the bulk material, it has proved to be particularly favorable to maintain a certain minimum filling of bulk material in the annular chamber mixing compartment (particularly in the lower part of the annular chamber with the two vertical boundary walls) during the mixing process. According to the invention, this result is achieved by arranging the material outlet opening in the outer boundary wall of the annular chamber at a higher level than the material inlet opening in the inner boundary wall. The material inlet opening is preferably situated substantially level with the base of the annular chamber.

Another particularly advantageous embodiment of this construction is characterised in that an overflow chute open overhead associated with the material inlet opening, extends radially between the inner and outer boundary walls of the annular chamber and is slightly inclined towards the outer boundary wall, its upper overflow edges determining the level of material inside the annular chamber. In this case, a closeable outlet opening for removing residues is best additionally provided in the outer boundary wall of the annular chamber below the material outlet opening level with the base of the annular chamber.

Another advantageous embodiment of the invention is characterised in that, of the base aeration zones which are present between the material inlet opening and the material outlet opening of the annular chamber, those zones situated directly adjacent the material inlet and material outlet openings are always capable of being vigorously aerated, at least two partial aeration zones being situated between them in the peripheral direction of the base, these partial aeration zones being designed solely for periodic aeration in alternation or succession in the sequence of their presence from the region of the material inlet opening to the material outlet opening. By virtue of this arrangement, it is possible even further to intensify and control the mixing and homogenising effect in the mixing compartment constructed in accordance with the invention by means of the pneumatic base aeration system, so that for example not only is the mixed material moved from the inlet opening to the outlet opening (in both peripheral zones of the annular chamber situated substantially opposite one another), upward and downward movements and possibly even lagging and leading movements of the mixed material along the mixing path from the inlet opening to the outlet opening of the mixing chamber are also superimposed on one another.

According to the invention, there are several constructional options, particularly for the annular chamber. Thus, in one embodiment of the invention, the annular chamber may form a peripherally uninterrupted mixing chamber. On the other hand, however, it is also possible to divide the annular chamber into two partial mixing chambers with their own material inlet openings. In this case, the annular chamber could contain partitions situated diametrically opposite the material outlet opening. In this embodiment, however, it is also possible to provide a control room or area accessible from outside and adjoined in each of the two peripheral directions by a partial mixing chamber in that annular section of the annular chamber which is situated diametrically opposite the material inlet opening, the material inlet opening of each partial mixing chamber being arranged immediately behind the partition to the control room. In this way, equipment essential to the operation of the silo, particularly for delivering and aerating the loose material, may be arranged in a readily accessible manner and may always be adequately monitored and maintained, if necessary even in operation.

In this case, too, the overflow chute associated with the inlet opening is best designed to serve both partial mixing compartments so that the intensively mixed batches of bulk material coming from the two partial mixing compartments may be additionally mixed with one another in the vicinity of the material outlet opening.

The silo construction according to the invention is particularly suitable for continuous mixing, although batch mixing would also be possible, particularly where the mixing compartment is divided into two partial mixing compartments.

DESCRIPTION OF THE DRAWINGS

Two embodiments of the invention are described in detail in the following with reference to the accompanying diagrammatic drawings, wherein.

DETAILED DESCRIPTION

Figure 1:
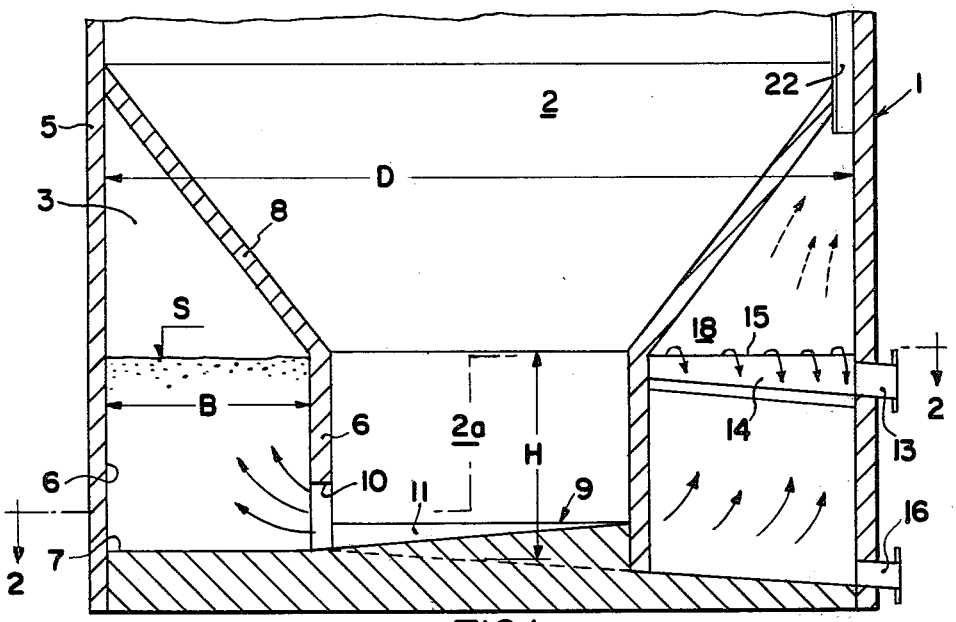
FIG. 1 is a vertical section through the lower part of the body of the storage and mixing silo.

A first embodiment of the storage and mixing silo intended in particular for fine-grained and powder-form bulk material will first be described with reference to FIGS. 1 and 2. In a common cylindrical body 1, the silo comprises a storage compartment 2 occupying by far the largest space and, at its lower end, a mixing compartment 3 which is smaller than the storage compartment 2.

The mixing compartment 3 is formed by an outer boundary wall 5, which may also be the outer wall of the silo body 1, by an inner boundary wall 6, by a base 7, and by an inclined cover wall 8 which also forms the inwardly inclined, funnel-like base of the storage compartment 2 and which therefore extends obliquely inwards from the upper region of the outer boundary wall 5 to the vertically directed inner boundary wall 6. Accordingly, the inner boundary wall 6 adjoins the lower edge of the funnel-shaped base (cover wall 8) of the storage compartment 2. The inner boundary wall 6 is formed by a cylindrical wall section of the storage compartment 2 which extends up to the central aeratable base section 9 of the storage compartment, resulting in the formation of a central, deep settling zone 2*a* in the lower part of the storage compartment 2.

At the lower portion of the mixing compartment is an annular chamber 4 having a height corresponding to that of the inner boundary wall 6. In the embodiment of FIGS. 1 and 2 the chamber 4 is peripherally uninterrupted.

In the inner boundary wall 6 of the annular chamber 4, a material inlet opening 10 is provided in the region of the base 7 of the annular chamber. A gathering conveyor 11 at the bottom of the storage compartment is associated with this material inlet opening 10 leading to the mixing compartment 3, being arranged in the central base section 9 of the storage compartment 2, preferably in such a way that it passes diametrically through this central base section 9. The gathering conveyor 11 may be a known pneumatic conveying chute with which standard pneumatic loosening units 12 also incorporated in the central base section 9 are associated on either side.

On that side of the annular chamber 4 which is situated diametrically opposite the material inlet opening 10, there is at least one material outlet opening 13 in its outer boundary wall 5. Shut-off and metering elements (not shown in detail) of conventional kinds may be associated in the usual way with this or these material outlet opening(s) 13. However, it is important that the material outlet opening(s) 13 in the outer boundary wall 5 should be situated at a higher level and the material inlet opening 10 at the base 7 in the inner boundary wall 6. It is of particular advantage to associate with the material outlet opening 13 an overflow chute 14 which extends radially between the inner and outer annular chamber boundary walls 6 and 5 and which is slightly inclined towards the outer boundary wall 5. This overflow chute 14 may be formed by a simple, inclined discharge chute or even by a pneumatic conveying chute or by any other suitable conveying element. In any event, the overflow chute 14 is open overhead or upwardly and the upper overflow edges 15 of the chute extend substantially horizontally and at the same level so that the material level S in the mixing compartment 3 is determined in this way.

To ensure that, where necessary, the annular chamber mixing compartment 3 may also be completely emptied, a closeable outlet opening 16 for emptying residues is best additionally provided in the outer annular chamber boundary wall 5 below the material outlet opening 13 level with the base 7 of the annular chamber. In this connection, it is also of advantage for the annular chamber 4 to be inclined at its base 7 in the peripheral direction from the material inlet opening 10 (in both peripheral halves of the annular chamber 4) towards the outlet opening 16 for emptying residues, as shown in FIG. 1.

To obtain a good mixing and homogenising effect, it has proved to be particularly favorable to adhere to certain structural dimensions for the annular chamber 4. Thus, the radial width B of the annular chamber 4 should be between 0.25 and 0.37, and preferably between 0.3 and 0.35, times the internal diameter D of the silo, whilst the height H of the chamber 4 between the inner and outer boundary walls 5 and 6 should be between about 0.7 and 1.4, and perferably between about 1.0 and 1.2 times the radial width B of the annular chamber 4. If, as in the embodiment shown in FIG. 1, the base 7 of the annular chamber is inclined towards the outlet opening 16 for removing residues, the mean height in the peripheral region between the material inlet opening 10 and the outlet opening 16 for emptying residues is regarded as the vertical height H.

Figure 2:
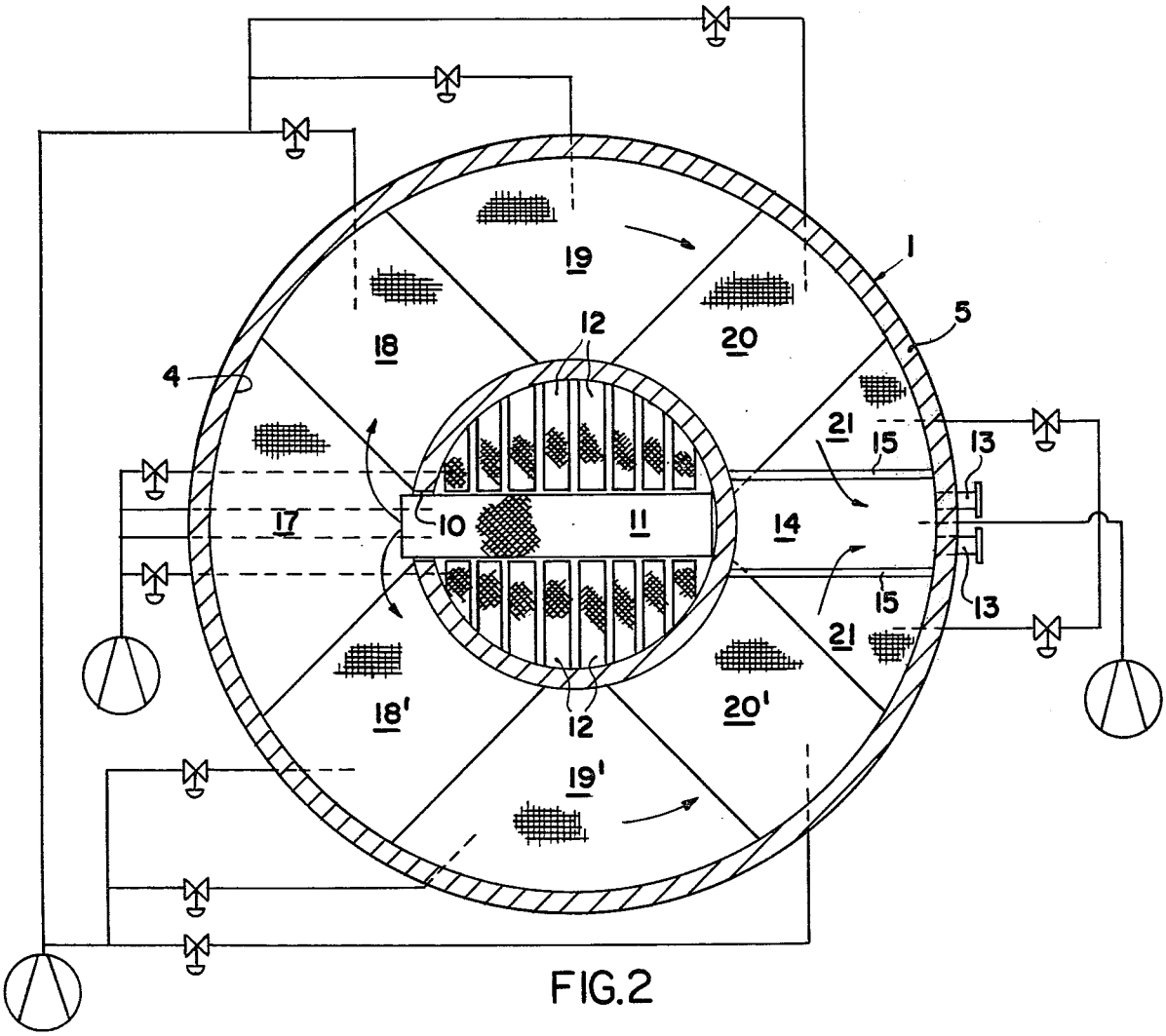
FIG. 2 is a cross-section on the line 2—2 in FIG. 1.

The base 7 of the annular chamber between the material inlet opening 10 and the material outlet opening 13 or the outlet opening 16 for emptying residues is best divided up into several independent air permeable aeration zones 17, 18, 19, 20, 18', 19', 20', 21', as shown in FIG. 2. Each of these aeration zones 17 to 21 and 18' to 20' may be pneumatically aerated independently of one another, for which purpose known porous aeration units are arranged in the base 7 and are served by conduits coupled to blowers via valving controllable separately in a manner known in the art from the aeration base of the storage compartment 2. Of these aeration zones, the aeration zone 17 associated with the material inlet opening 10 and the aeration zone 21 directly associated with the material outlet opening 13 are continuously and vigorously aerated during operation, preferably with equal intensity. Between these two aeration zones 17 and 21 operated at equal intensity, there are another three aeration zones 18, 19 and 20 in one peripheral half (or peripheral direction) of the annular chamber 4, while partial zones 18', 19' and 20' are also arranged—symmetrically to the zones 18, 19, and 20 mentioned above—in the other peripheral direction or peripheral half of the annular chamber 4. These aeration zones 18, 19, 20 and 18', 19' and 20' situated between the aeration zones 17 and 21 are only periodically supplied with air in successive alternation during operation in the sequence of their presence from the region of the material inlet opening 13—in their respective peripheral directions—to the material outlet opening 13, so that as it were a bubbling, extremely intensive mixing movement can be produced along the two mixing paths formed (in both peripheral halves of the annular chamber 4), as explained earlier herein.

So far as the structure and function of the annular chamber 4 are concerned, it is further pointed out that the upper part of the annular chamber 4 as it were forms a kind of expansion chamber and that, in a peripheral region of the annular chamber 4, an aeration pipe 22 opens into this upper expansion chamber. The aeration pipe 22 may be connected for example to a filter unit or, alternatively, may simply communicate with the upper part of the storage compartment.

Figure 3:
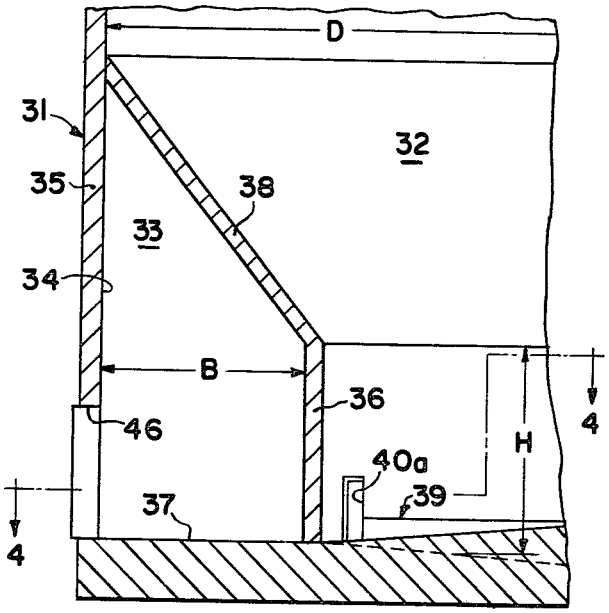
FIG. 3 is a vertical section similar to FIG. 1 (through the left-hand half only), but illustrating a second embodiment.
Figure 4:
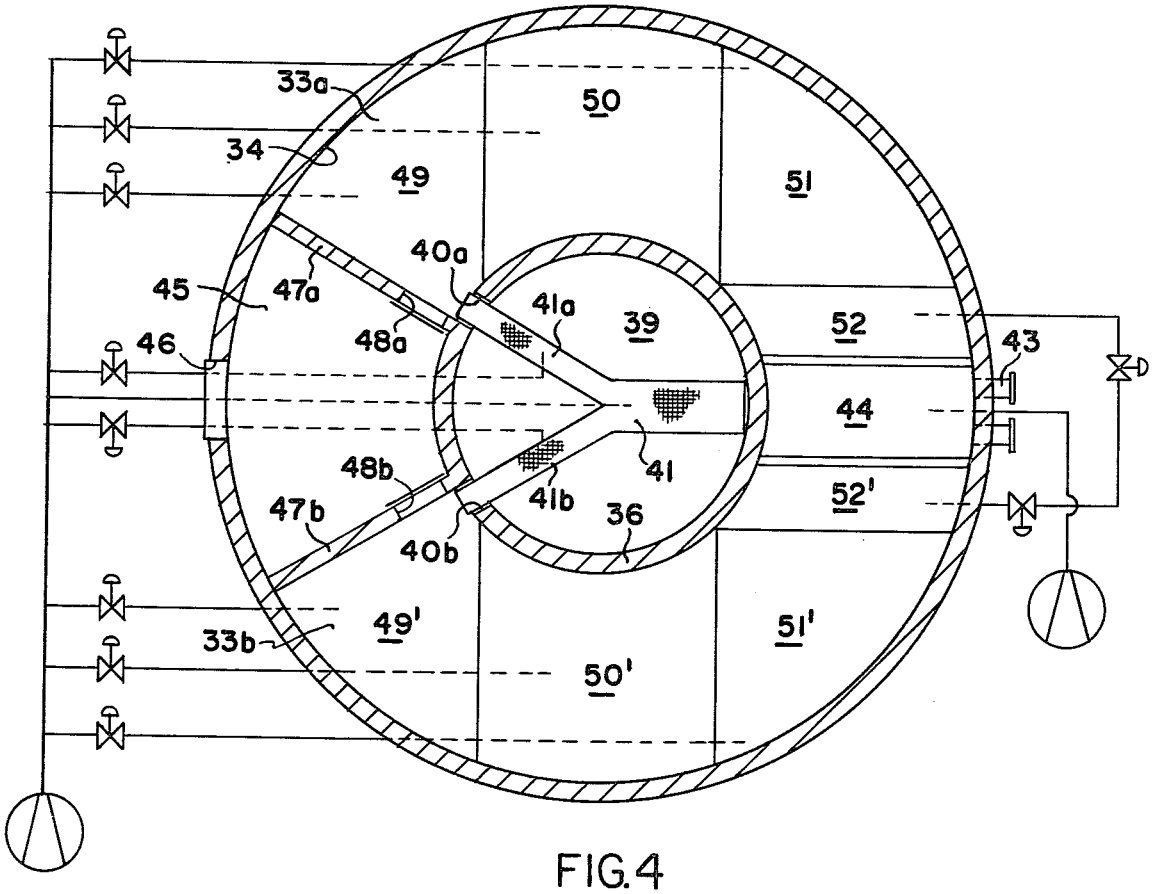
FIG. 4 is a cross-section on line 4—4 in FIG. 3.

A second embodiment of the storage and mixing silo is shown in FIGS. 3 and 4. By comparison with FIG. 1 of the first embodiment, FIG. 3 shows only the left-hand half of the silo body 31, while the right-hand half (not shown) may be constructed in exactly the same way as explained with reference to FIG. 1.

In this case, too, the silo body 31 contains a storage compartment 32 and a mixing compartment 33 which is smaller than the storage compartment 32 and which is formed by an annular chamber 34.

Externally, the annular chamber 34 is constructed in substantially the same way as the annular chamber 4 in the embodiment shown in FIGS. 1 and 2. That is, it comprises an outer boundary wall 35, an inner boundary wall 36, a chamber base 37 and a cover wall 38 extending obliquely downwards and inwards from an upper part of the outer boundary wall 35 to the inner boundary wall 36. In this second embodiment, too, the radial width B and the height H of the boundary walls 35, 36 of which the lower part at least extends vertically, are defined in exactly the same way as explained with reference to the internal diameter D of the silo in the description of FIGS. 1 and 2.

The main difference between this second embodiment and the embodiment shown in FIGS. 1 and 2 is that the annular chamber 34 is divided into two partial mixing compartments **33*a*, 33*b* each having its own material inlet opening 40*a*, 40*b* in the outer boundary wall 36. The inlet opening 40*a*, 40*b* to each partial mixing compartment 33*a*, 33*b* in turn communicates with a gathering conveyor 41*a*, 41*b* which is arranged in the central base section 39 of the storage compartment 32 and which, as shown in FIG. 4, may be formed by branches of a main gathering conveyor 41**.

As can clearly be seen from FIG. 4 in particular, the annular chamber 34 in this second embodiment comprises—in its annular section situated diametrically opposite the outlet opening 43—a control area 45 which is accessible from outside through a correspondingly large opening 46 in the outer boundary wall 35. This control area 45 may be used for fittings for aeration conduits and for fans. In addition, closeable access openings **48*a*, 48*b*** to the partial mixing compartments 33*a*, 33*b* are provided in radial partitions 47*a*, 47*b* which partly define the central area. As shown in FIG. 4, the material inlet opening 40*a*, 40*b* of each mixing compartment 33*a*, 33*b* is best arranged immediately adjacent the associated partition 47*a*, 47*b* of the control area 45. The overflow chute 44, which is constructed and arranged in exactly the same way as in the first embodiment, is best designed to receive mixed material from both the partial mixing compartments 33*a*, 33*b*, so that the material may be discharged collectively through the material outlet opening 43. It is pointed out at this juncture that in this second embodiment, too, the material inlet opening 40*a*, 40*b* of each partial mixing compartment 33*a*, 33*b* is situated in the region of the chamber base 37, whereas the material outlet opening 43 lies at a correspondingly higher level and, through its overflow chute 44, determines the level of material, i.e., the height of the material in the partial mixing compartments 33*a*, 33*b*.

The chamber base 37 is again divided into several individual aertation zones. In the region of the partial mixing compartment 33*a*, it contains the aeration zones 49, 50, 51, and 52 and, in the region of the partial mixing compartment 33*b* the aeration zones 49′, 50′, 51′ and 52′ lying substantially symmetrically in relation to the previously mentioned aeration zones, as illustrated in FIG. 4. During mixing, the aeration zones 49, 49′ and 52, 52′, which are situated immediately adjacent the respective outlet openings 40*a*, 40*b* and the outlet opening 43 in the two partial mixing compartments, may continuously be aerated with equal intensity, whereas the aeration zones 50, 51 and 50′, 51′ lying in between in both partial mixing compartments 33*a*, 33*b*, i.e., in both peripheral directions, may be periodically aerated in successive alternation in the sequence of their presence from the region of the material inlet opening to the material outlet opening.

With the two embodiments of the storage and mixing silo described above, it is possible to obtain particularly good mixing results in a continuous mixing process.

What is claimed is:

1. A storage and mixing silo for bulk material comprising an upstanding, cylindrical body having walls defining a storage compartment; radially inner and outer boundary walls and a base at the lower end of said body defining a mixing compartment having a lower annular chamber, said chamber and said storage compartment being in communication with one another via a material inlet opening in said inner boundary wall, and said outer boundary wall having at least one material outlet opening circumferentially spaced from said inlet opening; an overflow chute extending radially between said inner and outer boundary walls adjacent and in communication with said material outlet opening, said chute having upstanding overflow edges operable to determine the level of material in said mixing compartment; and air permeable means in said chamber extending circumferentially from said inlet opening to said outlet opening and forming a plurality of independently aeratable circumferentially extending zones, said annular chamber having a radial width of between about 0.25 and 0.37 times the diameter of said body and a height of between about 0.7 and 1.4 times said radial width.

2. A storage and mixing silo for bulk material comprising an upstanding, cylindrical body having walls defining a storage compartment; radially inner and outer boundary walls and a base at the lower end of said body defining a mixing compartment having a lower annular chamber, said chamber and said storage compartment being in communication with one another via a material inlet opening in said inner boundary wall, and said outer boundary wall having at least one material outlet opening circumferentially spaced from said inlet opening; a pair of radially extending, circumferentially spaced partitions in said annular chamber forming a control area diametrically opposite said outlet opening; and air permeable means in said chamber extending circumferentially from said inlet opening to said outlet opening and forming a plurality of independently aeratable circumferentially extending zones, said annular chamber having a radial width of between about 0.25 and 0.37 times the diameter of said body and a height of between about 0.7 and 1.4 times said radial width.

3. A storage and mixing silo for bulk material comprising an upstanding, cylindrical body having walls defining a storage compartment; radially inner and outer walls forming at the lower end of said body a mixing chamber external of said storage compartment, said chamber and said compartment being in communication with one another via a material inlet in said inner wall and said chamber extending arcuately from said inlet about said compartment toward a mixed material outlet substantially diametrically opposed to said material inlet; and air permeable means in said chamber extending from said material inlet to said mixed material outlet and forming a plurality of independently aeratable arcuately extending zones.

4. A silo according to claim 3 wherein said chamber has a radial width of between about 0.25 and 0.37 times the diameter of said body and a height of between about 0.7 and 1.4 times said radial width.

5. A silo according to claim 4 wherein the height of said chamber is between about 1.0 and 1.2 times said radial width.

6. A silo according to claim 3 wherein said chamber has a radial width of between about 0.3 and 0.35 times the diameter of said body.

7. A silo according to claim 3 wherein said storage compartment tapers inwardly at its lower end and adjoins said inner wall of said chamber.

8. A silo according to claim 7 wherein said storage compartment has a bottom at a level below that of said inner wall.

9. A silo according to claim 1 wherein said mixed material outlet is at a level above that of said material inlet.

10. A silo according to claim 3 including an overflow chute extending radially between said inner and outer walls adjacent and in communication with said mixed material outlet opening, said chute having upstanding overflow edges operable to determine the level of material in said chamber.

11. A silo according to claim 10 wherein said chute is inclined downwardly in a direction toward said outer wall.

12. A silo according to claim 3 wherein said chamber has a base and a second, normally closed mixed material outlet in said outer wall, said second outlet being at a level corresponding substantially to that of said base.

13. A silo according to claim 12 wherein the base of said chamber slopes in a direction from said material inlet toward said second outlet.

14. A silo according to claim 3 wherein said chamber is uninterrupted circumferentially.

15. A silo according to claim 3 wherein said chamber is interrupted by a pair of radially extending, circumferentially spaced partitions forming a control area diametrically opposite said mixed material outlet.

16. A silo according to claim 15 wherein each of said partitions has an inlet opening in communication with said storage compartment.

17. A silo according to claim 16 wherein said storage compartment has a bottom provided with conveyor means for delivering material from said storage compartment to each of the inlet openings in said partitions.

18. A silo according to claim 15 including an overflow chute extending radially between said inner and outer walls adjacent and in communication with said mixed material outlet.

19. A silo according to claim 3 wherein said storage compartment has a bottom provided with conveyor means for delivering material from said storage compartment to said material inlet.

20. A silo according to claim 3 including means for aerating each of said zones.

21. A silo according to claim 20 wherein those zones at each of said outlet and said inlet are aerated constantly and those zones between said inlet and said outlet are aerated periodically.

22. A silo according to claim 21 wherein those zones between said inlet and said outlet are aerated successively in a direction toward said mixed material outlet.

* * * * *